US005732932A

United States Patent [19]

Michalo

[11] Patent Number: 5,732,932

[45] Date of Patent: Mar. 31, 1998

[54] HYDRAULIC RAM ATTACHMENT FOR A RESCUE TOOL

[75] Inventor: Richard S. Michalo, Kettering, Ohio

[73] Assignee: American Rescue Technology Incorporated, Kettering, Ohio

[21] Appl. No.: 622,826

[22] Filed: Mar. 27, 1996

[51] Int. Cl.[6] ..... B66F 3/24

[52] U.S. Cl. ..... 254/93 R; 254/133 R; 254/131; 254/DIG. 4; 254/228

[58] Field of Search ..... 254/93 R, 93 H, 254/131, 133 R, DIG. 4; 269/902

[56] References Cited

U.S. PATENT DOCUMENTS

| | | | |
|---|---|---|---|
| 1,321,950 | 11/1919 | Templeton | 254/133 R |
| 1,514,262 | 11/1924 | Santmyer | 254/133 R |
| 1,859,954 | 5/1932 | Braumuller | 269/902 |
| 1,912,475 | 6/1933 | Countryman | 254/133 R |
| 2,408,181 | 9/1946 | Simonton | 254/93 R |
| 2,600,741 | 6/1952 | Drum | 254/DIG. 4 |
| 2,827,262 | 3/1958 | Fantaci | 254/133 R |
| 4,273,311 | 6/1981 | Rio . | |
| 4,330,104 | 5/1982 | Klok | 254/93 H |
| 4,333,330 | 6/1982 | Porter | 72/392 |
| 4,842,249 | 6/1989 | Weigand | 254/93 |
| 5,280,891 | 1/1994 | Estes | 269/902 |
| 5,406,826 | 4/1995 | Kuhlmann et al. . | |

FOREIGN PATENT DOCUMENTS

| | | | |
|---|---|---|---|
| 2089763 | 6/1982 | United Kingdom | 254/133 R |

OTHER PUBLICATIONS

Hurst Emergency Products Brochure dated Apr. 1991.

Walker Rescue Gator Catalog RG-8100 dated Jan. 1981.

*Primary Examiner*—Timothy V. Eley
*Assistant Examiner*—Lee Wilson
*Attorney, Agent, or Firm*—Thompson Hine & Flory LLP

[57] ABSTRACT

The invention is an attachment for a hydraulic rescue tool and a method of using the attachment. The attachment comprises a front face; a rear face; two opposing outer side faces; an inner bottom face, having grooves therein and being angled upwardly from the front face to the rear face; two inner side faces, the inner side faces being inclined with respect to the inner bottom face and having longitudinal grooves therein; the faces forming a unitary body having a generally flat V-shaped cross section. The method of using the tool includes providing an attachment tool having a front face; a rear face; two opposing outer side faces; an inner bottom face, having grooves therein and being angled upwardly from the front face to the rear face; two inner side faces, the inner side faces being inclined with respect to the inner bottom face and having longitudinal grooves therein; the faces forming a unitary body having a generally flat V-shaped cross section; attaching the attachment to a rescue tool; bracing the attachment against a portion of an object to be displaced; and activating the rescue tool to displace the object.

7 Claims, 2 Drawing Sheets

HYDRAULIC RAM ATTACHMENT FOR A RESCUE TOOL

BACKGROUND OF THE INVENTION

The present invention relates to an attachment for a rescue tool and a method of using the attachment, and more particularly, to a spreader plate attachment for a portable, hydraulic pushing ram rescue tool having an advantageous shape.

Typically, spreaders such as those utilizing hydraulic pushing rams have been used to aid in rescuing victims trapped within cars, trucks, aircraft, farm machinery and other confined spaces after an accident. These tools are typically used by fire departments, police departments, paramedic units, and others engaged in emergency rescue work to pry wreckage such as the steering column, dashboard, or other car parts away from a trapped victim so that they may be removed safely and quickly from the wreckage. Ends of the tools must apply opposing force between two surfaces such as the floor of the vehicle and the collapsed dashboard of a wrecked automobile. Hydraulic rams typically have plates on either end for support or bracing on the floor or other solid surface. Conventionally, these plates have been flat.

An example of such a hydraulic ram plate is disclosed in U.S. Pat. No. 4,273,311 to Rio. This patent teaches a flat, pivotable plate attached to each of two hydraulic force arms for spreading wreckage. The spreader plates also include a serrated gripping surface.

A disadvantage of such prior art systems is that they lack means for simulating the shape of a steering column or other non-planar surface and thus they tend to slide or do not grip well to non-planar surfaces. For example, if the object to be displaced is a dashboard of an automobile, the conventional head would be placed on the front of the door frame near the top (base of A post.) The base of the ram would be placed on the back of the door frame near the base. When the ram is actuated, the base of the ram pushes against the back of the door frame and displaces the dash. If the back of the door frame is rusted or missing due to another evolution, the ram has nothing to push against. Frequently, the back of the door frame is removed to extricate victims from the back seat of the vehicle. Further, the rescue workers must utilize a variety of sizes of hydraulic rams. Larger rams must be used for two-door cars versus four-door cars, due to the longer door frame. Smaller rams are used within the vehicle such as to lift the steering column. This creates extra pieces of equipment which must be carried to the accident scene.

Further, due to the high forces applied to small areas which may be made of plastic or light material. The tool may punch through the material and lose its grip. Also, difficulty arose in positioning the planar tool against a steering column so that the tip of the force arms engaged the steering column without sliding. All of these problems have a distinct disadvantage in that they add time to the rescue effort.

U-shaped plates have been developed which substantially complement the shape of the steering column of a vehicle. However, due to the smooth surfaces of the plate metal on the metal column, a suitable grip is not attained and the tool tends to slip. Further, there is no angle to the tools so that the flat side of the tool is required to apply pressure to an angled steering column.

Accordingly, there is a need for an attachment for a rescue tool which provides better gripping of surfaces and is adaptable to provide additional areas for the ram to push against. Further, there is a need for a versatile tool which is easy to position and use in close spaces and which is better suited for non-planar and angled surfaces.

SUMMARY OF THE INVENTION

The present invention is a hydraulic ram attachment for a rescue tool and a method of using the attachment. In a preferred embodiment of the invention, the attachment is substantially a flat V-shape and includes angled side walls having stepped surfaces and a grooved, angled bottom surface.

The attachment comprises a front face; a rear face; two opposing outer side faces; an inner bottom face, the inner bottom face having grooves therein and being angled upwardly from the front face to the rear face; two inner side faces, the inner side faces being inclined with respect to the inner bottom face and having longitudinal grooves therein; the faces forming a unitary body having a generally flat V-shaped cross section.

The method of using the tool includes providing an attachment tool having a front face; a rear face; two opposing outer side faces; an inner bottom face, the inner bottom face having grooves therein and being angled upwardly from the front face to the rear face; two inner side faces, the inner side faces being inclined with respect to the inner bottom face and having longitudinal grooves therein; the faces forming a unitary body having a generally flat V-shaped cross section; attaching the attachment to a rescue tool; bracing the attachment against a portion of an object to be displaced; and activating the rescue tool to displace the object.

Accordingly, it is an object of the present invention to provide an attachment for a rescue tool which is substantially a flat V-shape; an attachment in which grooves are etched into the tool to enhance the grabbing ability; an attachment which is angled so as to be shaped to fit a steering column for increased leverage or for digging into a base such as a rocker panel; an attachment which allows an infinite number of places in which the ram can push from; and an attachment which is relatively simple to use.

Other objects and advantages of the present invention will be apparent from the following description, the accompanying drawings and the appended claims.

DETAILED DESCRIPTION

Figure 1:
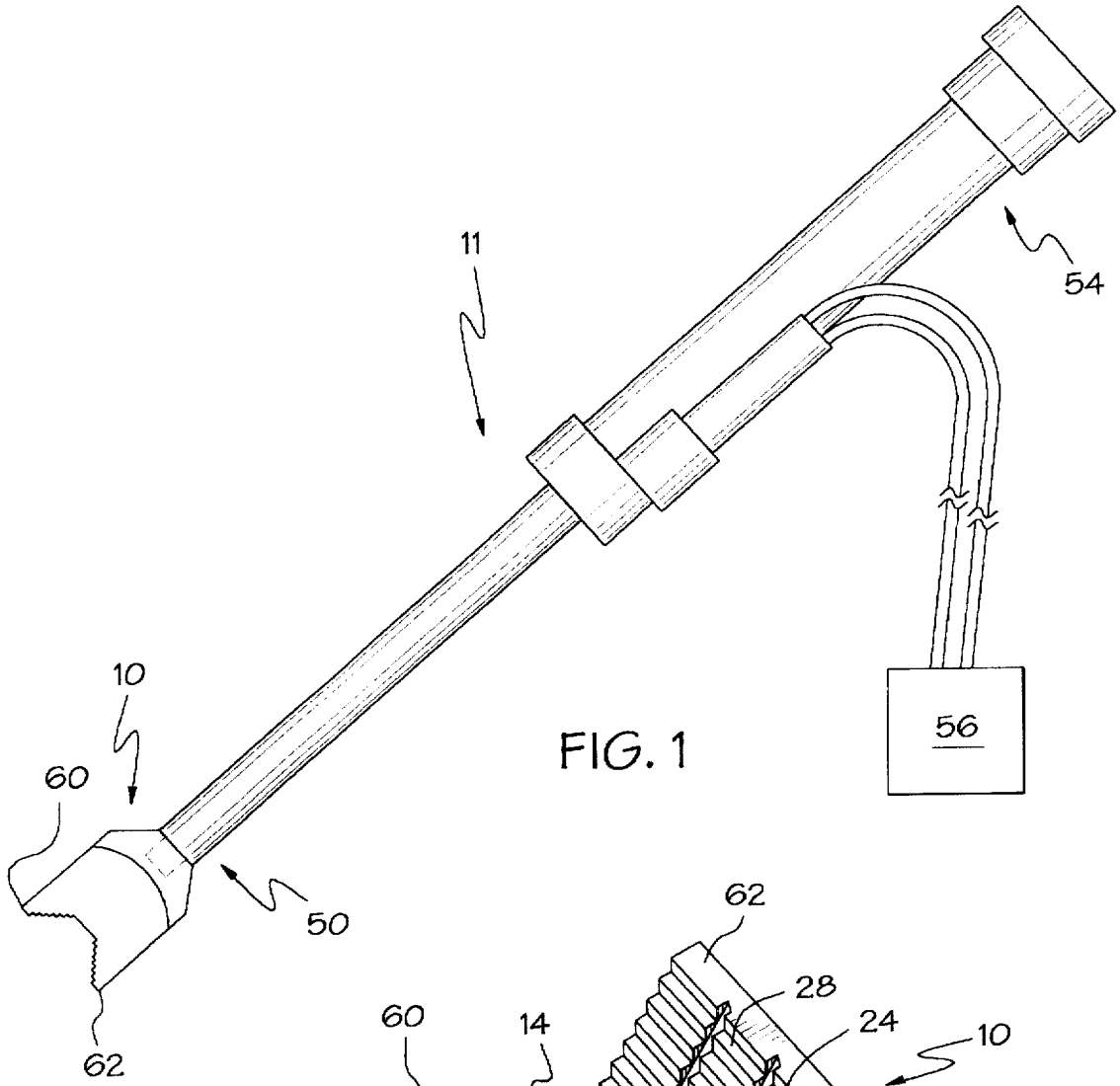
FIG. 1 is a front elevational view of a rescue tool attachment of the present invention connected to a hydraulic ram rescue tool.
Figure 2:
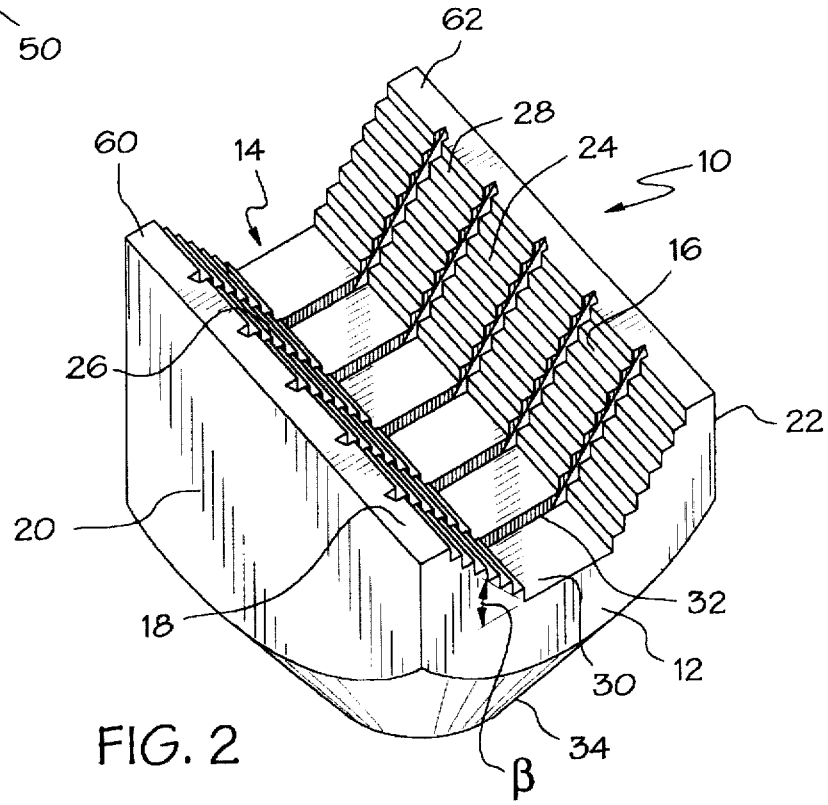
FIG. 2 is a front perspective view of the attachment of FIG. 1.

As shown in FIG. 1, a hydraulic ram attachment for a rescue tool generally designated 10 in accordance with the present invention is shaped to be threadably received on an end of a hydraulic pushing ram 11. The attachment 10 is preferably made of a high strength metal alloy having a Rockwell C hardness of 28 to 38, such as 4140 heat treated steel, S-5 or S-7 tool steel. The attachment 10 is neither flat nor U-shaped so that it may accommodate many surfaces. As shown in FIGS. 2–5, the attachment 10 includes a planar front face 12, a planar rear face 14 and two opposing sidewalls 16 and 18. The outer faces 20,22 of the side walls are planar are substantially parallel to each other. The inner faces 24,26 of the sidewalls 16,18 are stepped by grooves 28 to enhance the gripping ability of the attachment 10.

Figure 5:
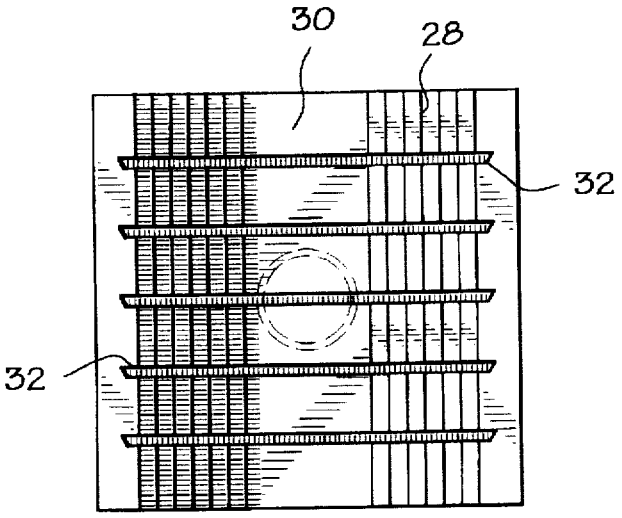
FIG. 5 is a top plan view of the attachment of FIG. 2.

The attachment 10 has a substantially flat, inner bottom surface 30 which extends between the inner surfaces of the sidewalls. This inner bottom surface contains grooves 32 therein. The grooves 32 extend up the inner faces of the sidewalls, as shown in FIG. 5, so that the sidewalls 16,18 have steps in the longitudinal direction 28 and grooves 32 in the lateral direction.

Figure 4:
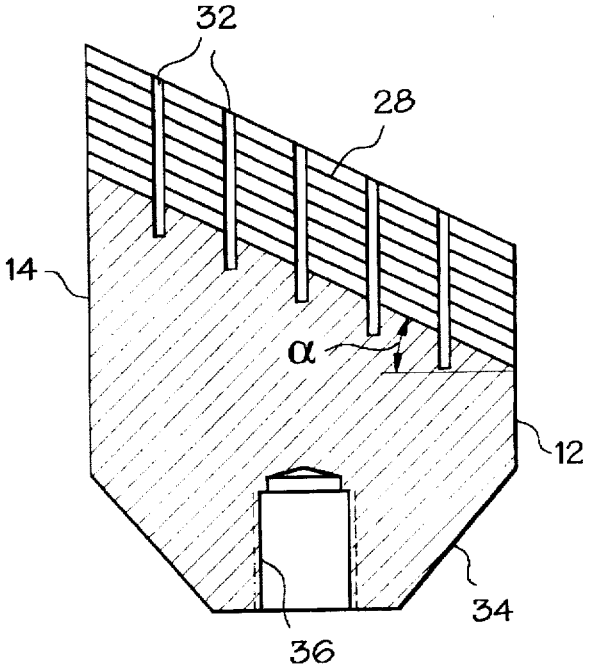
FIG. 4 is a cross-sectional view taken along the lines 4—4 in FIG. 3.

An important aspect of this invention is that the bottom surface 30 of the attachment 10 is angled upwardly from the planar front face 12 to the planar rear face 14. As seen in FIG. 4, this greatly increases the gripping ability of the attachment, as it can "dig in" to a surface. Also, as it approximates the angle of the steering column, it provides greater leverage while lifting to increase the pushing force. This angle $\alpha$ is preferably 20° to 30° from horizontal. Further, the angle provides points 60,62 which can pierce an object and then the shape provide a secure grip.

In addition, the inner surfaces of the side walls 24,26 are each inclined at an angle $\beta$ of approximately 40° to 50° with respect to the inner bottom face 30. This aids in self-centering the tool. In one embodiment of the invention, an angle $\alpha$ of 28° and an angle $\beta$ of 44° were found to be convenient.

Figure 3:
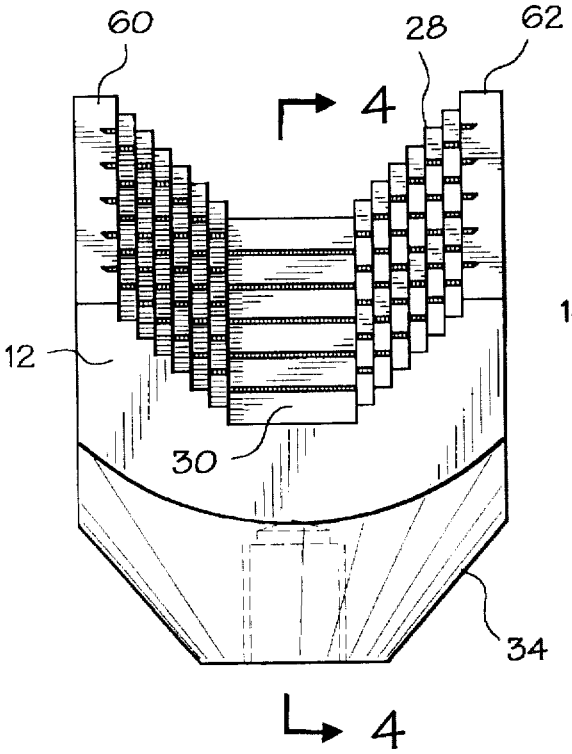
FIG. 3 is a front elevational view of the attachment of FIG. 2.

The bottom of the attachment 34 is non-planar and contains a threaded hole 36, as shown in FIGS. 3 and 4, for screwing the attachment 10 on to a threaded end of a hydraulic ram.

Not only does the present invention approximate the shape and angle of the steering column, and include both lateral 28 and transverse 32 cuts to allow better grabbing ability, the shape was found to be well suited for digging into rocker panels or other base objects to brace the hydraulic ram tool in a position while the proximate end pushes the wreckage. Therefore, the steps formed by the cuts 28 and 32 must not be so large that the ram head attachment will not be able to center itself or so small that the ram head attachment will not dig well into the wreckage.

The method of using the above-disclosed attachment will now be described with respect to FIG. 1. The attachment 10 is threadably attached to a proximate end 50 of a hydraulic ram rescue tool 11. The threaded hole 36 of the attachment 10 is screwed onto the corresponding portion of a hydraulic ram 11. The tool 10 is then inserted into the wreckage (not shown). Either the proximate 50 or distal 54 end of the tool is braced against a portion of the wreckage which is to be displaced. The other end is braced on a solid base surface such as the ground or another portion of the wreckage.

Next, the hydraulics 56 are activated to actuate the rescue tool 11 which applies opposing forces to displace the distal end with respect to the proximate end which displaces the portion of the wreckage to be moved with respect to the base. The trapped victim can then be extricated and the rescue tool can removed for later use.

For example, due to the configuration of the attachment 10, it can be braced on the rocker panel of an automobile in any one of an infinite number of places. Then, when the tool 11 is actuated by the hydraulics, the attachment "digs" into the rocker panel, piercing it with the upper points 60,62 of the attachment. Thereby, providing a sturdy base for the tool to push against. This also provides an advantage in that a smaller ram can also be used for a two-door automobile since the attachment can engage the rocker panel and does not need to stretch all the way to the back of the door frame.

If the object to be displaced is a dashboard of an automobile in a dash roll up, the shape of the ram head attachment 10 is shaped so that it pushes the weaker plastic dashboard out of the way. Then, due to the V-shape, it can center itself on the post and will not slip to the side. In contrast, with a conventional attachment, a rescuer would have to make several attempts to move the plastic dash out of the way in order to push against the sturdy portion of the post.

If the object to be displaced is a steering column of an automobile, the attachment 10 is fit under the bottom portion of the steering column and the distal end 54 of the tool 11 is braced on a solid surface. The grooves 32 on the bottom surface and the inner surfaces 24,26 of the side walls 16,18 prevent slippage and the angle $\alpha$ of the bottom surface 30 provides leverage to increase the pushing force on the steering column. Therefore, when the hydraulics activate the rescue tool 11, it displaces the steering column with respect to the base.

Having described the invention in detail and by reference to preferred embodiments thereof, it will be apparent that modifications and variations are possible without departing from the scope of the invention defined in the appended claims.

What is claimed is:

1. An attachment for a rescue tool comprising:

a front face;

a rear face;

two opposing outer side faces;

an inner bottom face having grooves therein and being inclined from said front face to said rear face;

two inner side faces, said inner side faces being inclined with respect to said inner bottom face and having longitudinal grooves therein;

all said faces forming a unitary body having a generally flat V-shaped cross section.

2. The attachment of claim 1 wherein said inner side walls have grooves extending both latitudinally and longitudinally thereon.

3. The attachment of claim 2 wherein said longitudinal grooves on said inner side walls aligned with said grooves on said inner bottom surface.

4. The attachment of claim 1 wherein said outer side faces are substantially parallel.

5. The attachment of claim 1 wherein said inner bottom face is inclined at an approximately 20 to 30 degree angle with respect to horizontal.

6. The attachment of claim 1 wherein said attachment is comprised of a material having a Rockwell C hardness of approximately 28 to 38.

7. The attachment of claim 1 further comprising a non planar outer bottom face, said outer bottom face having a threaded hole therein for attachment to a tool.

* * * * *